United States Patent [19]

Araki

[11] 4,302,743

[45] Nov. 24, 1981

[54] SOLENOID APPARATUS

[75] Inventor: Kazuo Araki, Tateyama, Japan

[73] Assignee: Kabushiki Kaisha Fujikoshi, Toyama, Japan

[21] Appl. No.: 87,484

[22] Filed: Oct. 23, 1979

[30] Foreign Application Priority Data

Oct. 26, 1978 [JP] Japan ..... 53-146419

[51] Int. Cl.[3] ..... H01F 7/10

[52] U.S. Cl. ..... 335/251; 335/244

[58] Field of Search ..... 335/251, 244, 243, 262, 335/255

[56] References Cited

U.S. PATENT DOCUMENTS 3,633,139 1/1972 Thompson ..... 335/255

4,142,169 2/1979 Katchka et al. ..... 335/251

*Primary Examiner*—Harold Broome

*Attorney, Agent, or Firm*—Spencer & Kaye

[57] ABSTRACT

An improved solenoid apparatus for operating valves such as hydraulic/air valves or other mechanical devices including a pressure proof tube which is wholly or partially nonmagnetic and has one end connected sealingly to a stationary core, an armature slidably mounted in contact with the inner face of the pressure proof tube, and a coil assembly comprising substantially a yoke and a coil encompassing the pressure proof tube. A cylindrical magnetic ring enclosing a part of the stationary core and a part of the pressure proof tube in the vicinity of the end face at the attracting side of the stationary core is inserted between the stationary core and the coil assembly the one end of the magnetic ring protruding axially over to the armature side, whereby the solenoid can be used either with alternating or direct current merely by replacing the coil assembly. When the solenoid is connected to an AC power source, there is no need to install a shading coil and therefore, the apparatus is low in cost and reliably endures impact loads.

6 Claims, 9 Drawing Figures

SOLENOID APPARATUS

BACKGROUND OF THE INVENTION

This invention relates to an improved solenoid apparatus for operating valves such as hydraulic/air valves or other mechanical devices.

In prior art solenoid apparatus of the type disclosed in U.S. Pat. No. 3,633,139 for mechanically actuating hydraulic/air valves and other mechanical devices, a shading coil is provided to suppress noise generated by the pulsatile attractive force associated with the armature and stationary core of the solenoid when single-phase AC current flows in the solenoid coil. The shading coil is usually brazed to one of the opposing faces of the stationary core and armature.

In such a case, the shading coil is liable to become detached due to shock caused when the armature collides with the stationary core, etc. and/or by vibration of the valve per se. Consequently there is a possibility the solenoid may break down. Besides, there are the disadvantages that the shading coil is expensive and requires a large number of man-hours for installation.

In addition, a solenoid which incorporates a shading coil for use with alternating current is sometimes unusable as a DC solenoid even though the coil assembly including the coil and yoke are replaced with a DC coil assembly including a coil and yoke, and the remaining portion of the solenoid sealed off with a pressure proof tube cannot be used with both alternating and direct currents.

SUMMARY OF THE INVENTION

It is a principal object of the present invention to overcome the disadvantages inherent in the above-discussed types of prior art solenoids and further provide a solenoid usable with both alternating and direct currents by replacing the coil assembly comprising the coil and yoke.

It is another object of the present invention to provide a solenoid which is of low cost and yet greatly repels shock together with precluding the necessity of installing a shading coil when connected to a single-phase AC power source.

These and other objects are attained by a solenoid apparatus according to the invention which is adapted for use with hydraulic/air valves or other machines wherein the solenoid apparatus includes a pressure proof tube which is wholly or partially made from non-magnetic material, an armature slidingly moving in contact with the inner face of the pressure proof tube, a stationary core secured to the end portion of the pressure proof tube and having a through opening in the vicinity of the axial center thereof, and a coil assembly having a coil and a yoke encompassing the pressure proof tube which attracts the armature when current flows in the coil. Further the solenoid apparatus comprises a cylindrical magnetic ring enclosing a part of the stationary core and a part of the pressure proof tube adjacent the end face at the attracting side of the stationary core, the magnetic ring being fitted fixedly between the stationary core and the coil assembly. In addition, the end portion at the armature side of the magnetic ring extends axially out over the end face of the attracting side of the stationary core adjacent the armature.

BRIEF DESCRIPTION OF THE DRAWINGS

The present invention will be more fully understood by reference to the following detailed description thereof when read in conjunction with the appended drawings, wherein like reference numerals refer to like elements and wherein.

DETAILED DESCRIPTION OF THE PREFERRED EMBODIMENTS

Figure 1:
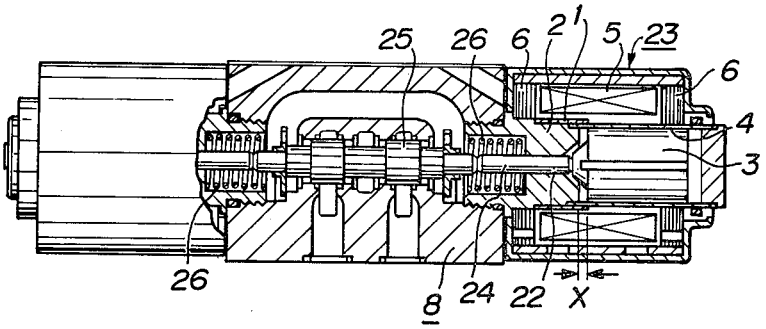
FIG. 1 is a partial sectional view of one embodiment of the present invention for use with alternating current.
Figure 2A:
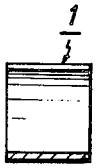
FIG. 2*a* is an axial sectional view and FIG. 2*b* a circumferential sectional view of the magnetic ring shown in FIG. 1.
Figure 2B:
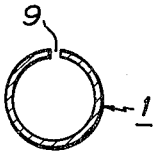
Figure 3:
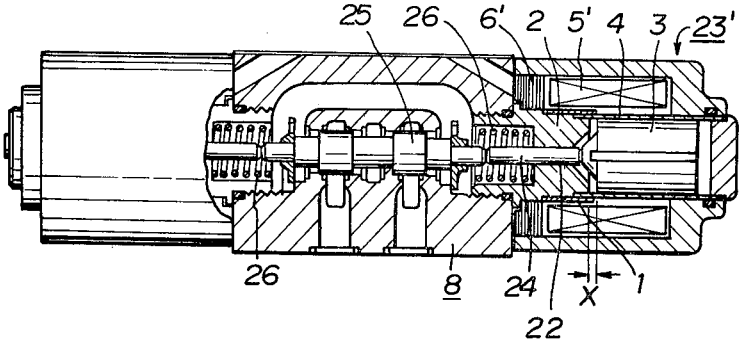
FIG. 3 is a partial sectional view of the present invention for use with direct current.

In FIG. 1, FIG. 2 and FIG. 3, a solenoid apparatus connected securely to a mechanical device, especially to a valve body (8) of a hydraulic or air valve comprises a pressure proof tube (4) having one end thereof sealed off with an end member. The pressure tube (4) may, as is well known, consist entirely of a relatively thin non-magnetic tube or of a relatively thick non-magnetic tube or of a relatively thick non-magnetic tube welded or otherwise connected to a relatively thick magnetic tube on both sides. The solenoid further comprises an armature (3) movable slidingly in contact with the inner face of the pressure proof tube (4) and having a push pin (24) fitted tightly at one end thereof, a stationary core (2) secured sealingly to the other end of the pressure proof tube (4) and having a through opening (22) in the vicinity of the axial center thereof, and a coil assembly 23 comprising a coil (5) and a yoke (6) encompassing the aforementioned pressure proof tube (4) and attracting the armature (3) when current flows in the coil (5).

The armature (3) and the coil assembly 23 are well known and therefore need not be described in detail herein.

The coil is connected to a DC or AC power source via lead wires and terminals (not shown).

In the solenoid apparatus of this invention, a cylindrical magnetic ring (1) enclosing a part of the stationary core (2) and a part of the pressure proof tube (4) is fixedly inserted between the stationary core and the coil assembly (23). The end portion of the magnetic ring (1) axially protrudes out over the end of the attracting side of the stationary core (2) as shown by the dimension (x) in FIG. 1.

In operation, the moment current flows to the coil (5) from a single-phase AC power source via lead wires and terminals not shown in FIG. 1, the armature (3) hits the stationary core (2) to push the pin (24) fixed to the armature (3), thereby displacing a spool (25) which is housed axially and slidably in the valve body (8). When no current flows in coil (5), the spool (25), pin (24) and armature (3) are restored to their original positions by a spring (26).

In the construction of the embodiment described above, the magnetic ring (1) acts in cooperation with the non-magnetic part of the pressure proof tube as an element which causes this part of the tube to substitute for a shading coil. Thus, this embodiment can be used as an AC solenoid with no shading coil being provided. Moreover, it is serviceable as a DC solenoid as shown in FIG. 3 by replacing the coil assembly (23) by a coil assembly (23') for a DC solenoid, coil assembly 23' comprising coil 5' and yoke 6'. (The operation in this case is similar to that described in FIG. 1 and therefore need not be described in detail herein).

The reason for providing the shading coil is to generate a phase difference between the magnetic flux passing inside the shading coil and that passing outside the coil thereby keeping an attractive force effectively across the magnetic poles even when the AC current flowing in the coil becomes zero. In the present invention, the magnetic flux reaching the armature (3) from the inner face of the nonmagnetic tubular element part of the pressure proof tube (4) and the magnetic flux from the portion of the magnetic ring (1) fitted outside the nonmagnetic tubular part are available. And, the nonmagnetic part of the tubular element works as if it were the aforesaid shading coil to provide a phase difference between the two magnetic fluxes. Consequently, the disadvantages inherent in the single-phase AC solenoids of the prior art, such disadvantage being that the shading coil easily comes off due to impact by a moving core and/or vibration of the valve per se resulting in the operational failure of the solenoid can successfully be eliminated. Further, extra man-hours and costs are no longer required.

While on the other hand, when the solenoid is used as a DC solenoid by conducting direct current through the coil (5') from a DC power source through lead wires and terminals (not shown) as viewed in FIG. 3, the area of the stationary core end face adjacent the armature (3) increases only by an amount corresponding to (x) at the end of the magnetic ring. The result is that the magnetic reluctance of the magnetic path for the solenoid reduces and the magnetic flux of the magnetic path increases thereby considerably augmenting the attractive force. Thus, by replacing the coil assembly (23'), the remaining portion of the solenoid sealed off by the pressure proof tube (4) is available as a solenoid operable with both alternating and direct currents. The stationary core (2) can be connected to the nonmagnetic tubular element forming the pressure proof tube (4) either by brazing or other suitable welding method or by bonding. However, when connected by brazing, since the electric resistance of the brazing filler metal is in general less than that of the non-magnetic pressure proof tube made from SUS 304 (Japanese Industrial Standard—equivalent to AISI 304), more current flows to the brazed part and the nonmagnetic tubular part, the increased current corresponding to the change in magnetic flux at the end face of the stationary core. And, in this case, more current flows than in the case where the connection is made merely by welding. Therefore a significant effect is ensured when the nonmagnetic tubular element functions as a shading coil.

Figure 8:
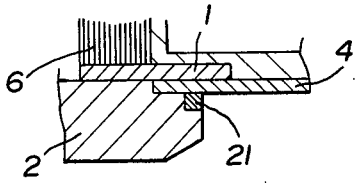
FIG. 8 is a sectional view of a major portion of an embodiment differing from the embodiments shown in FIG. 1 and FIG. 3.

When the solenoid of this invention is used as an AC solenoid, as shown in FIG. 8, so long as the nonmagnetic portion of the pressure proof tube (4) is constructed of a material with a relatively low electric resistance such as brass or copper, or when the nonmagnetic tubular element is connected by brazing, a conductive shading coil (21) can be brazed to the outer circumferential portion of the end face at the attracting side of the stationary core (2), i.e. at a corner contacting the nonmagnetic portion of the pressure proof tube 4.

Even when the device is used as an AC solenoid by conducting alternating current to the coil, the area of the attracting face of the stationary core substantially increases only for the ring end portion as when the device is used as a DC solenoid. The result is that more magnetic flux flows for the same number of ampere turns; that is, the current times the number of turns of wire in the coil causing the coil current to decrease at a point where the stroke of the armature from the end face of the stationary core is identical compared with that of the case where no ring is provided.

Moreover, this invention is applicable to either the case where the stationary core (2), is made in one integral piece with silicon steel or constructed of laminating silicon steel sheets, or where the armature (3) is made up of one piece of silicon steel having a partially or wholly laminated construction.

The material, configuration and size of the magnetic ring 1 may be selected according to the magnetic force of the solenoid. And, so long as the ring is preferably made from a material endowed with a high saturated magnetic flux density and/or permeability in silicon steel sheets, an even greater effect would be assured.

Also, the magnetic ring (1) may be constructed with a plurality of laminated silicon steel sheets so that the ring can provide more serviceability for an AC solenoid.

When adapting the magnetic ring (1) to the solenoid used with an AC source, it is preferred that a slot (9) cut through axially be provided as shown in FIG. 2 to minimize circumferential current generated inside the magnetic ring (1).

Figure 4:
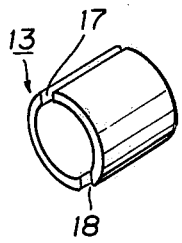
FIG. 4 through FIG. 7 show perspective views of various magnetic rings which differ from the magnetic ring of FIG. 2.
Figure 5:
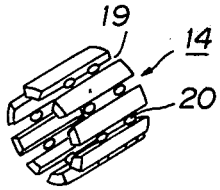
Figure 6:
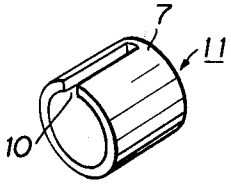
Figure 7:
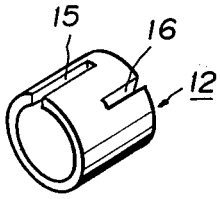

Moreover, two slots (17) and (18) may be provided as shown in FIG. 4 or a plurality of slots (19) may be obtained by welding individual sections with a connecting member (20), as shown in FIG. 5. Also, one axial slot (10) may be made with a circumferential connected portion (7) kept left in the magnetic ring (11) as shown in FIG. 6 or a plurality of slots (15) and (16) may be provided preferably opposed to each other as shown in FIG. 7.

The solenoid apparatus of the present invention is so constructed as to eliminate the need for a shading coil; however, even when the solenoid apparatus is used with a shading coil attached to the attracting end face of the stationary core or armature (which has been employed widely together with the solenoid apparatus of this invention for use only with alternating current), a satisfactory effect can nevertheless be obtained because the magnetic ring projects over the end face of the stationary core toward the armature.

Also, when using the apparatus as an AC solenoid, it is more effective to attach a copper ring to the inner side of the magnetic ring of this invention.

As stated above, this invention can provide a solenoid apparatus which is usable with both alternating and direct currents by replacing the coil assembly. It is particularly useful because the extra man-hours and costs involved in installation of the shading coil in a single-phase AC solenoid of the prior art have been eliminated. Also, the disadvantages that the shading coil easily comes off due to shock, etc. having been overcome.

In various preferred embodiments of the present invention mentioned above, a push-type solenoid apparatus (wherein a valve spool is preferably pushed by a push pin engaged to an armature) has been described and it is however to be understood by those skilled in the art that this invention would also be applicable to a pull-type solenoid apparatus (wherein a valve spool is preferably pulled by a pull pin fitted fixedly both to an armature and the spool).

Therefore in this invention, the term "solenoid apparatus" includes both push-type and pull-type solenoids.

Although preferred embodiments of this invention have been described in considerable detail for illustrative purposes, many changes or modifications may be made by those skilled in the art without departing from the scope of the appended claims. It is therefore desired that the protection afforded by Letter Patent be limited only by the true scope of the appended claims.

What is claimed is:

1. A solenoid apparatus adapted for use for hydraulic-/air valves or other mechanical devices including a pressure proof tube made from nonmagnetic material, an armature slidably mounted in contact with the inner face of said pressure proof tube, a stationary core secured sealingly to the end portion of said pressure proof tube and having a through opening in the vicinity of the axial center thereof, and a coil assembly including a coil and a yoke surrounding said pressure proof tube and attracting the armature when current flows in said coil, wherein the improvement comprises a cylindrical magnetic ring enclosing a part of said stationary core and a part of said pressure proof tube adjacent the end face at the attracting side of said stationary core, said magnetic ring being fitted fixedly between the stationary core and said coil assembly, an end portion of said magnetic ring adjacent said armature protruding out over the end face at the attracting side of said stationary core toward the armature side thereof.

2. A solenoid apparatus according to claim 1 wherein said pressure proof tube is substantially brazed to said stationary core.

3. A solenoid apparatus according to claim 1 or 2 wherein said cylindrical magnetic ring has at least one slot extending along the entire length thereof.

4. A solenoid apparatus according to claim 1 or 2 wherein said cylindrical magnetic ring has at least one axial slot extending along part of the length thereof, said ring having a circumferential connected portion.

5. A solenoid apparatus according to claim 1 or 2 wherein a conductive shading coil is brazed to the circumferential portion of the end face at the attracting side of said stationary core.

6. A solenoid apparatus according to the claim 1 or 2 wherein said cylindrical magnetic ring substantially comprises a plurality of laminated sheets.

* * * * *